US006234694B1

(12) United States Patent
Brookner

(10) Patent No.: US 6,234,694 B1
(45) Date of Patent: May 22, 2001

(54) MEDIA CONTROL TO ELIMINATE PRINTING IMAGES BEYOND THE MEDIA BOUNDARIES

(75) Inventor: George Brookner, Norwalk, CT (US)

(73) Assignee: Ascom Hasler Mailing Systems Inc., Shelton, CT (US)

( * ) Notice: Subject to any disclaimer, the term of this patent is extended or adjusted under 35 U.S.C. 154(b) by 0 days.

(21) Appl. No.: 09/331,450

(22) PCT Filed: Jul. 29, 1998

(86) PCT No.: PCT/US98/15713

§ 371 Date: Jul. 16, 1999

§ 102(e) Date: Jul. 16, 1999

(87) PCT Pub. No.: WO99/06217

PCT Pub. Date: Feb. 11, 1999

Related U.S. Application Data

(60) Provisional application No. 60/053,833, filed on Jul. 29, 1997.

(51) Int. Cl.[7] ..... B41J 11/44

(52) U.S. Cl. ..... 400/76; 400/708; 347/104

(58) Field of Search ..... 400/71, 76, 708; 101/71; 250/559.19, 559.39, 559.05, 559.07; 347/104

(56) References Cited

U.S. PATENT DOCUMENTS

| | | | | |
|---|---|---|---|---|
| 4,978,973 | * | 12/1990 | Ogushi et al. | 400/708 |
| 5,314,256 | * | 5/1994 | Niwa | 400/76 |
| 5,316,396 | * | 5/1994 | Fukaya | 400/76 |
| 5,350,245 | | 9/1994 | Gallagher . | |
| 5,399,030 | * | 3/1995 | Niwa et al. | 400/76 |
| 5,440,979 | | 8/1995 | Bonham et al. | 101/91 |
| 5,524,995 | | 6/1996 | Brookner et al. . | |
| 5,535,127 | * | 7/1996 | Uno et al. | 382/101 |
| 5,724,245 | * | 3/1998 | Maher et al. | 101/71 |
| 5,726,894 | * | 3/1998 | Sansone | 101/71 |
| 5,729,461 | * | 3/1998 | D'Andrea et al. | 101/71 |
| 5,762,427 | | 6/1998 | Gilham . | |
| 5,787,406 | * | 7/1998 | Arsenault et al. | 101/71 |
| 5,822,739 | * | 10/1998 | Kara | 705/410 |
| 5,957,600 | * | 9/1999 | Ju | 400/76 |
| 5,978,781 | * | 11/1999 | Sansone | 101/71 |

FOREIGN PATENT DOCUMENTS

| | | | | |
|---|---|---|---|---|
| 0 285 454 A2 | | 5/1988 | (EP) . | |
| 0109380 | * | 6/1984 | (JP) | 400/708 |
| 0115877 | * | 7/1984 | (JP) | 400/708 |
| 0004088 | * | 1/1985 | (JP) | 400/708 |
| 4003039282 | * | 2/1991 | (JP) | 400/708 |
| 405931709 | * | 5/1993 | (JP) | 400/708 |

OTHER PUBLICATIONS

Supplementary European Search Report dated Jul. 21, 2000, 2 pages.

Xerox Disclosure Journal "Smart Tray for Paper Size Indication" vol. 20, No. 2, Mar.–Apr. 1995, p. 187–188.*

Xerox Disclosure Journal "Typewriter Bottom Margin Indicator" vol. 4, No. 6, Nov/Dec. 1979, p. 815.*

* cited by examiner

*Primary Examiner*—Eugene Eickholt
(74) *Attorney, Agent, or Firm*—Perman & Green, LLP

(57) ABSTRACT

To facilitate printing of postage or other images onto media of variable size, an apparatus determines the size of the medium in at least one dimension prior to or during the printing of the image, such that the image to be printed is adjusted based upon the determined size of the medium. The apparatus may be a postage meter, in which case information is received by a data processor concerning the size of a mail piece and the postal value. An initial image is made up of a fixed portion, including postal indicia, and a user-defined variable portion, is then altered in view of this input to provide a final image for printing on the mail piece which fits fully on the mail piece. The alteration effects only the variable portion of the image, which may be truncated, scaled or replaced with a different variable portion.

21 Claims, 3 Drawing Sheets

MEDIA CONTROL TO ELIMINATE PRINTING IMAGES BEYOND THE MEDIA BOUNDARIES

This application is a 371 of PCT/US98/15713 filed Jul. 29, 1998 and claims benefit of 60/053,833 filed Jul. 29, 1997.

BACKGROUND OF THE INVENTION

This application relates to an apparatus for printing images on media of variable size, and particularly to an apparatus for printing of postal indicia, and to a related method.

Printing of images (text or graphics) onto paper or polymer media has become increasing commonplace, making use of many different printer types including ink jet and laser printers. The media onto which the printing is done can be of many different sizes. This is particularly true in the case of postage meters which may be used to print postal indicia and optional advertisements or other material onto envelopes and postcards of a great many different sizes.

Typically, the material to be printed by a postage meter or other printer is determined without regard for the actual size of the media being processed through the meter. In some cases, for example in word processing applications, the presumed size of the medium is known. There may, however, be no check to confirm that the size of the media actually loaded into the printer conforms to the expected size.

When the media used is smaller in size than the standard which was used to determine the size of the printed material, a portion of the image may be printed onto the transport mechanism of the printer, i.e, onto the platen. This not only results in an incomplete image which is esthetically unpleasing, it has several additional detrimental effects. If a second page or piece is printed immediately (before the ink on the platen has dried), this can result in a reverse image being formed on the backside of the second page or piece. In any event, the printing of the image onto the platen results in the accumulation of ink on the platen which can impair the efficiency of the printing operation if the platen is not cleaned at reasonable intervals.

U.S. Pat. No. 5,316,396 discloses a printer in which an image to be printed is adjusted in size to compensate for a change in paper size. There is no disclosure, however, of the detection of size of individual pieces of paper.

U.S. Pat. No. 5,678,124, describes a printing apparatus which employs a mechanism for measuring an elapsed time for feeding a sheet of paper from its top edge to its bottom edge by feeding a first paper. The apparatus then calculates the paper size on the basis of the measured time and the paper feeding rate and compares this result with the paper size specified by an external apparatus. When the actual and expected size are different, a warning display informs the operator of the mismatch, and provision is made for reprinting of incorrectly printed pages after the insertion of paper of the correct size. Similarly, U.S. Pat. No. 5,464,204 discloses a printer with a paper feed controlling device which, in the operation of a laser printer at a high speed intended to attain a maximum throughput, does not allow the feeding of a second sheet of paper to be initiated until after the size of a first sheet of paper already fed has been detected. In both of these apparatus, however, an initial piece of paper is used to determine the size of the paper and is wasted if the size is not the expected size. This is acceptable where printing of multiple page documents is common, and where the value of the wasted piece is limited. In the context of a postage meter, however, mail pieces are frequently printed individually such that the size of one mail piece is not a valid predictor of the size of the next. Furthermore, if the wasted piece is a mail piece of a size other than that expected by the system, the wastage would include the value of the postage printed upon the piece. Such wastage would not be merely incidental.

It would therefore be advantageous to have a printer, and particularly a printer for use in conjunction with a postage meter for printing of postal indicia which noted the actual size of the first piece of media loaded in the printer and adjusted the size and/or content of the image being printed accordingly. It is an object of the present invention to provide such an apparatus. It is a further object of the present invention to provide a method for the printing of images, including postal indicia and a variable portion, in which the size and/or content of the variable portion of the image is adjusted based upon the actual size of the media on which the image is to be printed.

SUMMARY OF THE INVENTION

These and other objects are met by an apparatus for printing an image onto a medium, such as a paper or envelope, comprising:

(a) a data processor or similar means for defining the image to be printed;

(b) drive rollers or similar means for transporting the medium from a first location to a second location;

(c) a print head, such as an ink jet print head, for printing the image on the medium as it is transported from the first location to the second location; and (d) means for determining the size of the medium in at least one dimension-prior to or during the transport of the medium from the first location to the second location, wherein the image to be printed is adjusted based upon the determined size of the medium, The apparatus can be used for carrying out the method of the invention for printing of images comprising postal indicia and a user defined variable portion. In accordance with this method, a preliminary image is defined, and then modified in response to information concerning the size of the media onto which the image is to be printed. This modification effects only the variable portion of the image, which may be truncated, scaled or replaced with a different variable portion.

DETAILED DESCRIPTION OF THE INVENTION

In the most general sense, the present invention provides an apparatus for printing an image onto a medium. A preferred embodiment of the present invention relates to the printing of postal indicia, i.e, an indication of an amount of postage together with a mailing location and date. For purposes of example, the apparatus of the invention will be discussed with particular focus on this preferred embodiment.

Figure 1:
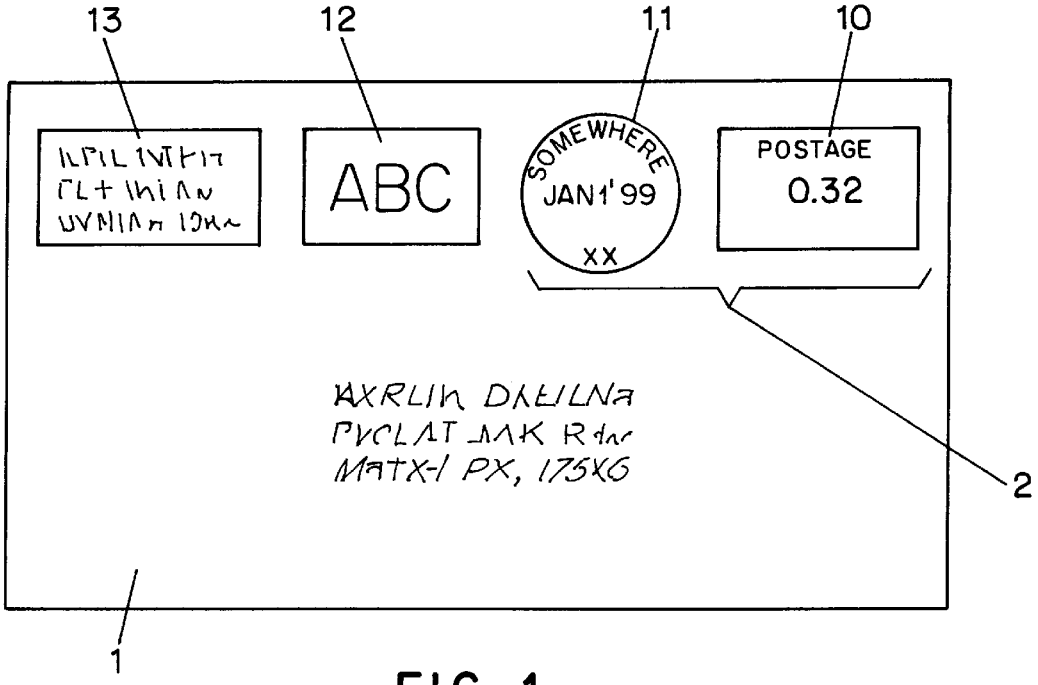
FIG. 1 shows a representative mail piece with postal indicia and other materials printed thereon.

FIG. 1 a representative mail piece containing postal indicia and other materials which may be printed using the method and apparatus of the present invention. As shown, the postal indicia 2 on the mail piece 1 includes a region 10 indicating the amount of the postage and a region 11 indicating the point of origin and the date of mailing printed in the upper right hand corner of the mail piece. The size and other characteristics of these two regions is fixed by regulation. It will be appreciated by persons skilled in the art that proposals now exist for modification of the format of printing postal indicia, to include bar codes or other machine readable structures to facilitate the use of a broader range of printer types. Such postal indicia are included within the scope of the present invention.

In addition to the postal indicia, a variable portion of the printed image that is defined by the user may be disposed along the upper edge of the media. Examples of such variable portions are an advertisement block 12, printed by the same printer as the postal indicia 2, and a return address block 13. The return address block may be pre-printed or it may be printed using the same printer as the postal indicia.

The printing of postal indicia and associated user-defined variable portions of a print image present unique challenges, not encountered in ordinary printing. The printed postal indicia has attributes of a negotiable instrument, and care must be taken to ensure that charges are properly entered corresponding to each printing of postage on a mail piece. As noted above, this processing of a charge for each printing of postage makes misprints economically undesirable for the user. The printing of postal indicia also presents special challenges, because of the variety of different media sizes which may be encountered, and the frequency with which individual mail pieces, as opposed to multiple pieces known to be the same size, are printed.

Figure 2A:
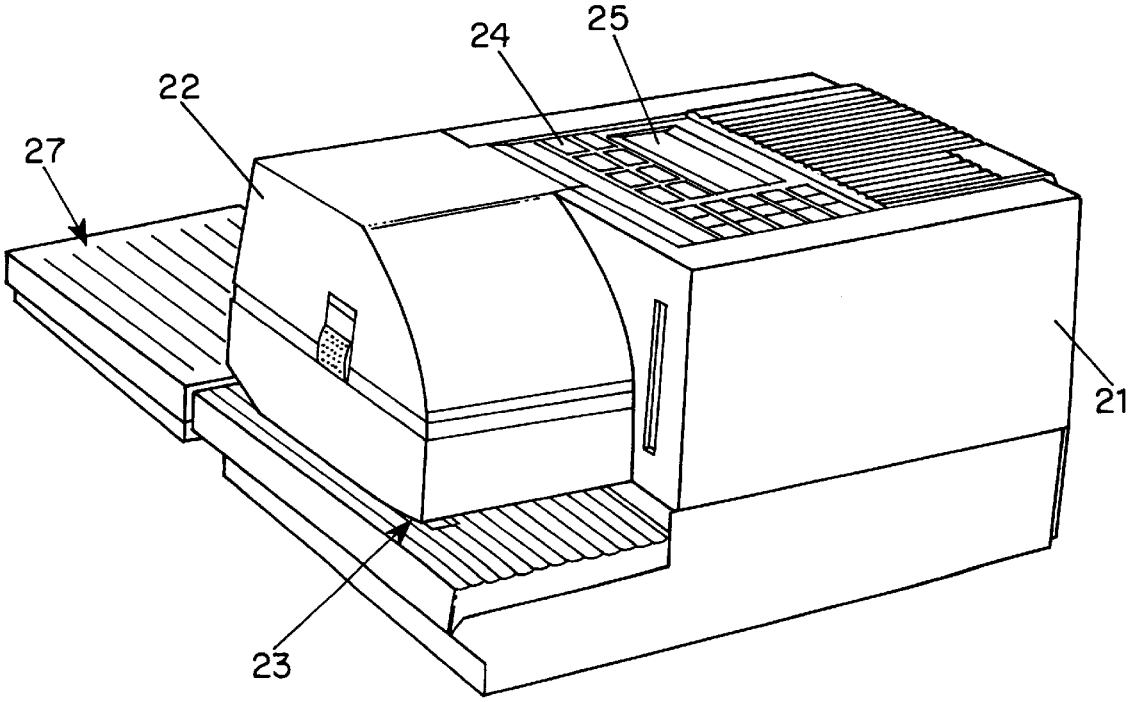
FIGS. 2A and B shows a representative postage meter in accordance with the invention.

To meet these challenges presented in the printing of postage on mail pieces, the present invention provides an apparatus comprising:

(a) means for defining the image to be printed;

(b) means for transporting the medium from a first location to a second location;

(c) means for printing the image on the medium as it is transported from the first location to the second location; and (d) means for determining the size of the medium prior to or during the transport of the medium from the first location to the second location, wherein the image to be printed is adjusted based upon the size of the of the medium determined by the mean for determining. FIGS. 2A and B shows an exterior view of a representative postage meter which is a preferred embodiment of the apparatus in accordance with the invention. It will be appreciated by persons skilled in the art, however, that this meter is a very basic embodiment, and that a great many additional features and enhancements (for example automatic weighing of mail pieces etc) are included in known postage meters and that these features and enhancements may be employed in the apparatus of the present invention.

Figure 2B:
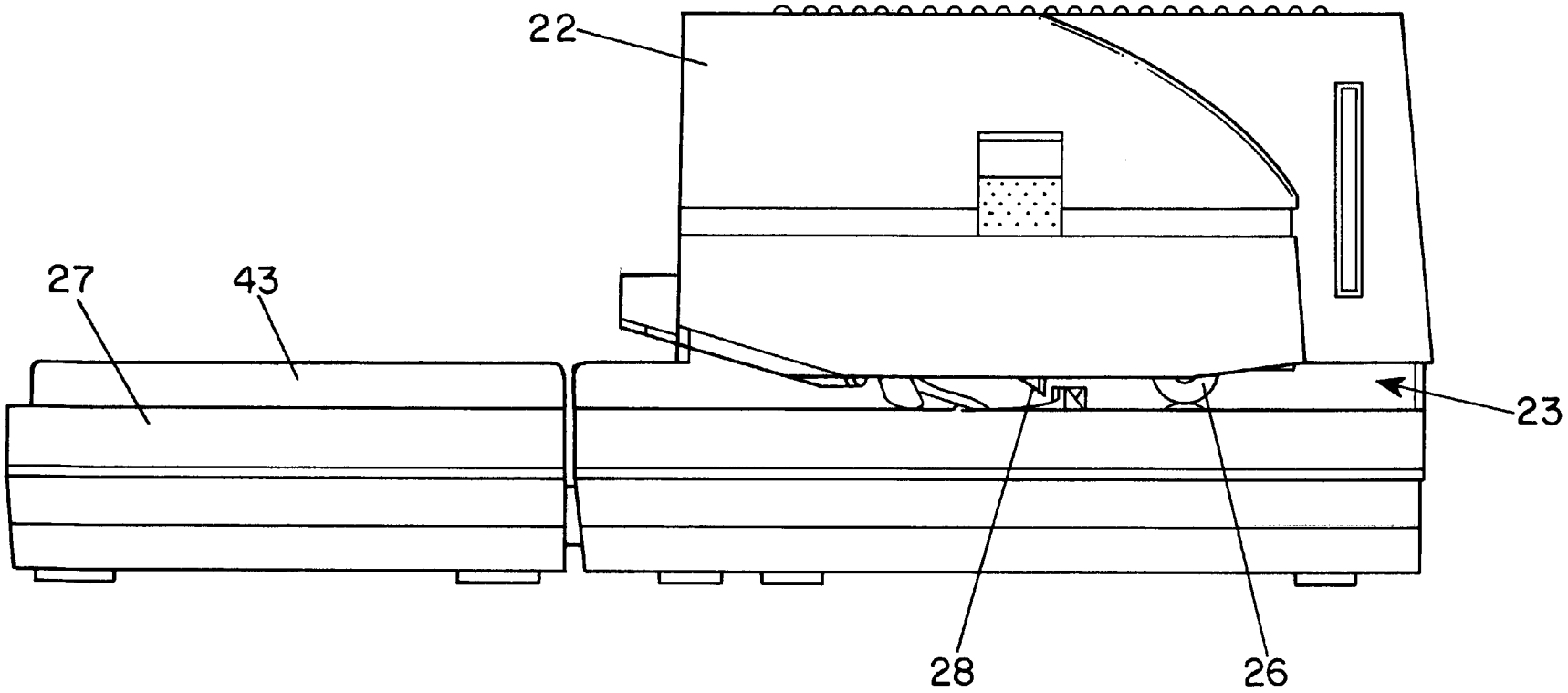

As shown in FIGS. 2A and B, the postage meter comprises a main housing 21, which securely encloses the operative portions of the meter to prevent fraudulent printing of postage. A print head is disposed within print head enclosure 22, in juxtaposition to a slot 23 such that an envelope passing through the slot can be printed with an image comprising postal indicia and other user-defined materials. A keypad 24 is disposed on the exterior surface of the housing 21 to permit user input of information concerning the mail piece. A display screen 25 such as an LCD display may be provided to echo user input and provide advice to the user about the status of the meter. Upon actuation of a switch 28 within the slot 23, a mail piece is transported through the slot 23 by rollers 26 in a direction from left to right in FIG. 2B. The switch may be mechanical in nature as shown, or of some other type such as the optical switch described in U.S. Pat. No. 5,495,103 which is incorporated herein by reference. At the input side of the main meter housing is an attached envelope stacker 27, which is electronically coupled to the main housing. The envelope stacker 27 includes means for determining the size of envelopes placed on the surface thereof, and may be detachable, as shown, or formed as an integral part of the postage meter.

Figure 3:
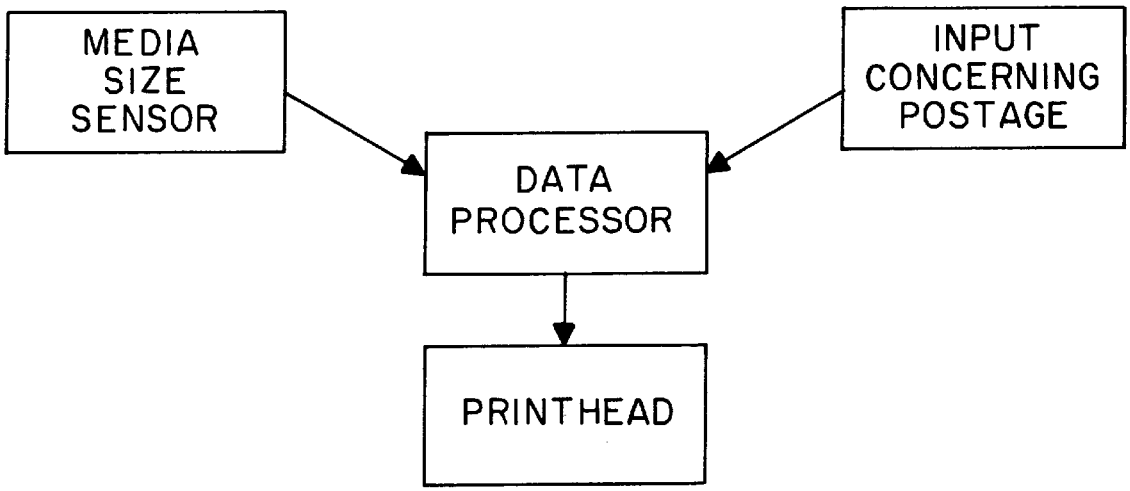
FIG. 3 shows a schematic of the data transfer processes in the apparatus of the invention.

As illustrated schematically in FIG. 3, in the apparatus of the invention, a data processor for defining the image to be printed is disposed within the main housing 21 of the postage meter as shown in FIGS. 2A and B. The specific size and nature of the data processor will depend on the complexity of the image to be printed. However, the basic technology for building an image whose content is based upon input about the mail piece from external sources, such as a user or an electronic scale are known, for example from U.S. Pat. Nos. 5,778,347, 5,765,475 and 5,729,461 which are incorporated herein the reference.

In a preferred embodiment of the apparatus of the present invention, the data processor receives input concerning the postage value, for example from the keypad 25 of the meter or from an associated scale indicating the weight of the mail piece. The data processor further receives input from the media size sensors disposed in envelope stacker 27, and then transmits print instructions to the print head.

The print instructions transmitted by the data processor provide an image having a fixed portion and a variable portion. The fixed portion includes the postal indicia and is defined in part by the inputs received concerning the postal value. The variable portion is user-defined, and is varied by the data processor in response to inputs concerning the size of the media. Several alternatives adjustments to the print instructions for the variable portion are contemplated within the scope of the present invention.

In a first embodiment of the invention, the print content of the variable portion is simply truncated so that no printing occurs beyond a desired endpoint on the media. This approach answers the concern of over-printing onto the platen, but does not produce the most aesthetically pleasing result.

In a second embodiment of the invention, the print content of the variable portion is truncated along defined boundaries within the image, such that a portion (up to and including 100%) of the content of the variable portion is omitted entirely if the size of the media is too small. Thus, for example if the default print content includes postal indicia 2 and an advertisement 12 as shown in FIG. 1, then the data processor may truncate the printed image to exclude the advertisement when the size of the media is determined to be below a threshold level. Alternatively, the data processor may have stored therein a plurality of advertisements 12. A selection of the advertisement 12 of the most appropriate size is then made by the data processor based upon the size of the media being printed.

In the third embodiment of the invention, the print content of the variable portion may be scaled to fit within desired boundaries once the size of the media being printed is transmitted to the data processor. It will be appreciated that the size of the postal indicia is set by regulation in most instances and thus may not be altered. However, of the variable portion, i.e., advertisements or other optional content, of the printed material may be adjusted in size to fit the size of the media prior to printing.

The three embodiments discussed above for adjustment of print content based on the size of the media are not exclusive and may be used in combination with one another. Thus, for example, when small media is used, certain elements of a default print image may be truncated or omitted, while others are scaled to fit the media.

Significant aspects of the present invention are the measurement of the media to be printed, and the temporal relationship of this measurement with the printing process. Specifically, the measurement process must occur sufficiently prior to the printing of those portions of the printed materials that are altered in response to the measured media size to permit modification of the image.

Figure 4:
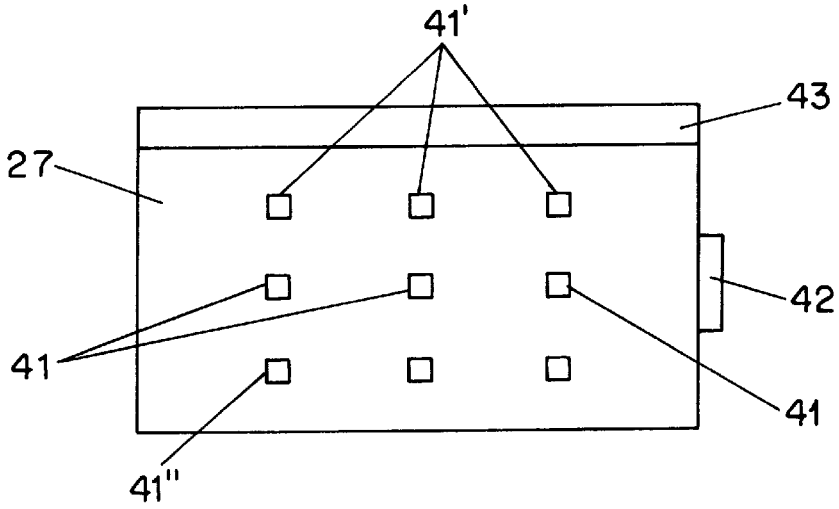
FIG. 4 shows an embodiment of the invention using microswitches to detect the size of the media to be printed.
Figure 5:
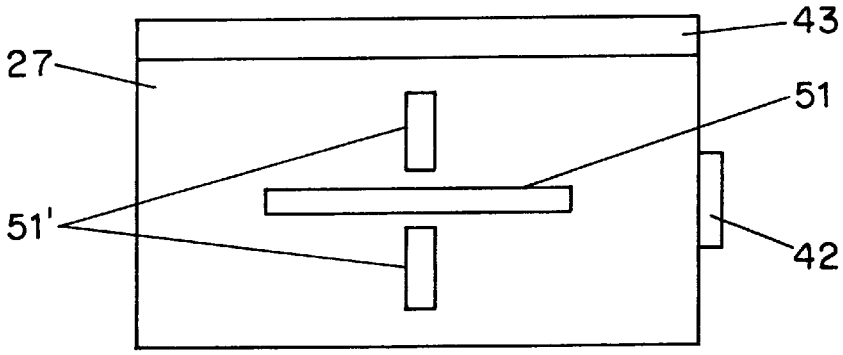
FIG. 5 shows an embodiment of the invention using optical sensors detect the size of the media to be printed.

The measurement of the media can be accomplished using any type of sensor which can detect the boundaries of the media. Thus, as shown in FIG. 4, which is a top view of an envelope stacker 27, the apparatus of the invention may include a plurality of microswitches 41 disposed at intervals to provide an indication of the dimension of the media. The stacker 27 is connected to a postage meter via a data connection 42 to provide information concerning the depression of one or more of the microswitches 41. By sampling the condition of the microswitches just after activation of the of the switch 28, but before transport of the envelope has commenced, the length of the media in the stacker 27 can be determined. If additional rows of microswitches 41' and 41" are employed, the width of the media can be determined as well. It will be appreciated that other types of sensors can be used in place of the microswitches, as described above. Thus, for example, one could use optical sensors 51, 51' disposed within the surface of the stacker 27 as shown in FIG. 5.

Another measurement approach is the use of LED-phototransistor pairs. The presence of the print media blocks the passage of photons, permitting software to learn the presence of the print media.

The number and arrangement of the sensors employed is a matter of user preference. In general, envelopes and similar media come in established sizes, such that it may be sufficient to place rows of sensors in lines corresponding to these sizes, or to the most common of these sizes. Similarly, the position of the sensors may be varied. Thus, while FIGS. 4 and 5 shows sensors disposed on the flat top surface of envelope stacker 27, sensors might also be disposed along the back rail 43 of the stacker 27.

In addition to static detection methods, the size of the media may be determined using dynamic processes, i.e., processes that occur while the media is being transported past the print head. Such processes include techniques for sensing leading or trailing edges, frequently employing optical sensors for example a sensor such as that described in U.S. Pat. No. 5,495,103; strobe counts during media or print head movement and the like. For example, a single microswitch or sensor can be placed in the path of travel of the media, at a position under the media at the start of a print cycle., The time between the start of the transport of the media and the time when the end of the media passes the sensor is then determined, to provide an indication of length of the medium in the print direction.

What is of importance to the apparatus of the present invention if operating in a dynamic mode is that the determination of media size occur at a time which permits the adjustment of the variable portions of the image to be printed, such as the user-defined advertisements. Thus, it is possible to start the printing process and to adjust the variable portions of the image which can be truncated, scaled or eliminated while the fixed portions of the image, e.g. the postal indicia, are being printed.

The apparatus discussed above can be used to perform the method of the present invention. In accordance with this method, an image is printed on a mail piece by first defining an initial image comprising a fixed portion including postal indicia and a user-defined variable portion. The size of the mail piece in at least one dimension is then determined. This size is used as a basis for altering the variable portion but not the fixed portion of the initial image to form a final image, which is printed on the mail piece. The variable portion is altered in response to the determined size of the mail piece such that the entire final image fits within a selected region of the mail piece. The extent of this selected region is an item of user preference, but will generally involve retain some appropriate margin edge at all edges of the mail piece.

The nature of the alteration to the variable portion may take various forms. In one embodiment, the variable portion is altered by truncating the initial image when determined size of the medium is below a threshold level. In another, the variable portion is altered by adjusting the size of at least a part of the variable image portion. In a third, the variable portion is altered by replacing at least a part of the variable portion from the initial image with a different variable image portion selected from among a set of variable image portions of varying sizes. Combinations of these various alterations techniques may also be employed without departing from the scope of the invention.

What is claimed is:

1. A postage meter apparatus for printing postal indicia onto a medium, comprising:

(a) means for defining the image to be printed;

(b) means for transporting the medium from a first location to a second location;

(c) means for printing the image on the medium as it is transported from the first location to the second location; and (d) means for measuring the size of the medium in at least one dimension prior to or during the transport of the medium from the first location to the second location, wherein the image to be printed is adjusted based upon the measured size of the medium.

2. The apparatus of claim 1, wherein the means for defining the image to be printed defines an image made up of a fixed image portion comprising postal indicia and a variable image portion comprising user defined material.

3. The apparatus of claim 2, wherein the means for defining the image to be printed truncates the variable image portion in response to the measured size of the medium.

4. The apparatus according to claim 2, wherein the means for defining the image to be printed adjusts the size of at least a part of the variable image portion in response to the measured size of the media.

5. The apparatus according to claim 2, wherein the means for defining the image to be printed selects from among a set of variable image portions of varying sizes in response to the measured size of the media.

6. The apparatus according to any of claims 1 to 5, wherein the means for measuring the size of the medium comprises at least one optical sensor.

7. The apparatus of claim 1, wherein the means for measuring the size of the medium in at least one dimension comprises means for detecting boundaries of the medium in said at least one dimension.

8. An apparatus for printing an image onto a medium, comprising:

(a) means for defining the image to be printed;

(b) means for transporting the medium from a first location to a second location;

(c) means for printing the image on the medium as it is transported from the first location to the second location; and (d) means comprising at least one microswitch for determining the size of the medium in at least one dimension prior to or during the transport of the medium from the first location to the second location, wherein the image to be printed is adjusted based upon the measured size of the medium.

9. The apparatus of claim 8, wherein the means for defining the image to be printed defines an image made up of a fixed image portion comprising postal indicia and a variable image portion comprising user defined material.

10. The apparatus of claim 8, wherein the means for defining the image to be printed truncates the variable image portion in response to the determined size of the medium.

11. The apparatus according to claim 8, wherein the means for defining the image to be printed adjusts the size of at least a part of the variable image portion in response to the determined size of the media.

12. The apparatus according to claim 8, wherein the means for defining the image to be printed selects from among a set of variable image portions of varying sizes in response to the determined size of the media.

13. A stacker for use in conjunction with a postage meter, said stacker comprising means for measuring the size of media placed in the stacker, and means for transferring the measured size to a postage meter to which the stacker is connected.

14. The stacker of claim 13, wherein the means for measuring the size of the media comprises at least one optical sensor.

15. The stacker of claim 13, wherein the means for measuring the size of media placed in the stacker comprises means for detecting boundaries of the media in at least one dimension.

16. A stacker for use in conjunction with a postage meter, said stacker comprising, means comprising at least one microswitch for determining the size of media placed in the stacker, and means for transferring the determined size to a postage meter to which the stacker is connected.

17. A method for printing an image onto a mail piece, comprising (a) defining an initial image comprising a fixed portion including postal indicia and a user-defined variable portion;

(b) measuring the size of the mail piece in at least one dimension;

(c) altering the variable portion but not the fixed portion of the initial image to form a final image for printing; and (d) printing the final image on the mail piece, wherein variable portion is altered in response to the measured size of the mail piece such that the entire final image fits within a selected region of the mail piece.

18. The method of claim 17, wherein the variable portion is altered by truncating the initial image when measured size of the medium is below a threshold level.

19. The method of claim 17, wherein the variable portion is altered by adjusting the size of at least a part of the variable image portion.

20. The method of claim 17, wherein the variable portion is altered by replacing at least a part of the variable portion from the initial image with a different variable image portion selected from among a set of variable image portions of varying sizes.

21. The method of claim 17, wherein the step of measuring the size of the mail piece in at least one dimension comprises detecting boundaries of the medium in said at least one dimension.

* * * * *